US005363775A

United States Patent [19]

Simpson

[11] Patent Number: 5,363,775

[45] Date of Patent: Nov. 15, 1994

[54] KNOCK-DOWN BOOKCASE

[76] Inventor: Barry Simpson, R.R. 1 Box 156, Warren, Vt. 05674

[21] Appl. No.: 127,300

[22] Filed: Sep. 27, 1993

[51] Int. Cl.[5] ..... A47B 3/00

[52] U.S. Cl. ..... 108/187; 108/180; 108/153

[58] Field of Search ..... 108/193, 153, 187, 188, 108/180; 211/186, 195, 189

[56] References Cited

U.S. PATENT DOCUMENTS

| | | | |
|---|---|---|---|
| Re. 28,244 | 11/1974 | Evans | 108/187 X |
| 241,645 | 5/1881 | Gilfillan et al. | 108/153 |
| 2,366,677 | 1/1945 | Rosenthal | 108/180 X |
| 2,560,957 | 7/1951 | Johnson | 211/186 X |
| 2,855,260 | 10/1958 | Reiss et al. | 211/186 X |
| 4,563,040 | 1/1986 | Alster | 108/153 X |
| 4,635,564 | 1/1987 | Baxter | 108/153 X |
| 5,279,232 | 1/1994 | Gollick | 108/153 X |

*Primary Examiner*—Jose V. Chen
*Attorney, Agent, or Firm*—Cesari and McKenna

[57] ABSTRACT

A knock-down bookcase and shelf unit includes a pair of upright mirror image side members and a plurality of shelves which extend through relatively large openings in the side members, with the shelves being supported on the bottom edges of those openings so that the shelves lie in horizontal planes. Abutments are provided to prevent the shelves from shifting laterally relative to the side members. Also, an elongated, flexible resilient slat is positioned under each shelf with the opposite ends of the slat engaging in slits in the side members. Other abutments are provided to maintain the slats in a bowed condition so that the slats exert outward forces on the side members thereby stiffening the unit as a whole while supporting the shelves from below.

15 Claims, 2 Drawing Sheets

KNOCK-DOWN BOOKCASE

BACKGROUND OF THE INVENTION

This invention relates to a bookcase or shelf unit. It relates more particularly to a knock-down bookcase which can be shipped and purchased as a relatively flat package and which can be assembled and disassembled by the purchaser without any tools at all.

There is a myriad of different free standing bookcases and shelf units on the market today. Many of these pieces of furniture are of the knock-down variety in that they may be purchased as a kit or package and assembled by the purchaser. In effect, the manufacturer saves storing and shipping costs by passing on to the consumer the cost of assembling the bookcase.

Many conventional knock-down bookcases of this general type are disadvantaged in that they require the installation of various fasteners and fixtures in order to hold the components of the bookcase together to form the finished product. In some cases, parts may be missing from the kit, requiring the purchaser to go back to the manufacturer to obtain same. In some instances, to avoid customer dissatisfaction, the manufacturer may supply extra fasteners in the kit which increases manufacturing costs. In other instances, the fasteners are built into the structural components of the bookcase so that by turning the fasteners, one component of the kit can be fastened to another component thereof. However, these built-in fasteners also increase the overall cost of the bookcase.

There do exist some knock-down bookcase and shelf units which do not require fasteners to connect together the various parts of the unit. However, such bookcases are usually not very strong and resistant to racking. Therefore, they are unable to stably hold a heavy load of books or other objects. Furthermore, prior knock-down bookcases and shelf units of this general type are not particularly aesthetically pleasing and, therefore, do not add to the decor of the room in which they are situated.

SUMMARY OF THE INVENTION

Accordingly, it is the object of tile present invention to provide an improved knock-down bookcase or shelf unit.

Another object of tile invention is to provide an article of furniture of this type which is aesthetically pleasing.

Another object of the invention is to provide a knock-down bookcase or shelf unit which is unusually stable.

Yet another object of the invention is to provide such a bookcase which requires no fasteners or other hardware in order to secure together the various components of the bookcase.

A further object of tile invention is to provide a bookcase or shelf unit of this general type which can be assembled easily by the average purchaser.

Yet another object of the invention is to provide a knock-down bookcase or shelf unit which can be manufactured in quantity at relatively low cost using a numerically controlled router.

Still another object is to provide a bookcase or shelf unit which is environmentally sound.

Other objects will in part be obvious and will in part appear hereinafter.

The invention accordingly comprises the features of construction, combination of elements, and arrangement of parts which will be exemplified in the following detailed description, and the scope of the invention will be indicated in the claims.

Briefly, my bookcase comprises a pair of mirror image side members and a plurality of identical shelves.

The side members and shelves may be made of wood, particle board, plastic or other suitable rigid material. Most preferably, it is made of fiberboard which is basically a waste product of the lumber and plywood industries. Therefore, the article is environmentally sound. If not made by hand, the components of the bookcase can be made quite easily using a numerically controlled router or other comparable machine tool. The bookcase components may be either finished or unfinished.

The side members of the bookcase are formed with relatively large openings having bottom walls which are horizontal when the side members are standing upright, the number of such openings in each side member corresponding to the number of shelves in the bookcase. The side member openings are large enough so that when the shelves are tilted about their longitudinal edges, the shelves can be inserted into the corresponding openings in the side members. Slots are provided in the opposite longitudinal edges of the shelves so that when the shelves are inserted into the openings in the side members and seated flat against the bottom walls of those openings, the slots receive the side edges of those openings thereby fixing the fore and aft and lateral positions of the shelves relative to the side members.

In order to rigidify tile bookcase or shelf unit after the shelves have been mounted to the side members as aforesaid, special flexible resilient slats are provided which are positioned under the shelves. preferably at the rear edges thereof. Each slat is received in a recess at the underside of the corresponding shelf with its opposite ends engaging in slots in the upright members. Each slat is somewhat longer than the distance between the upright members so that when inserted into the slots, it assumes a bowed condition within the recess of the corresponding shelf. In the final stage of bookcase assembly, the slats are straightened out whereupon they snap to an over center condition in their respective recesses such that they push the upright members apart thereby effectively locking the shelves to the upright members and rigidifying the bookcase as a whole.

Preferably, the components of the bookcase are shipped in a knocked-down condition as a relatively flat package or kit. In that package, the slats repose in the recesses in the undersides of the shelves, and the shelves are sandwiched between the two side members which have substantially the same overall dimensions as the shelves. Therefore, when the two upright members are strapped together, they restrain all of the other bookcase components comprising the kit to facilitate shipping and handling.

BRIEF DESCRIPTION OF THE DRAWINGS

For a fuller understanding of the nature and objects of the invention, reference should be had to the following detailed description, taken in connection with the accompanying drawings, in which.

DETAILED DESCRIPTION OF ILLUSTRATIVE EMBODIMENT

Figure 1:
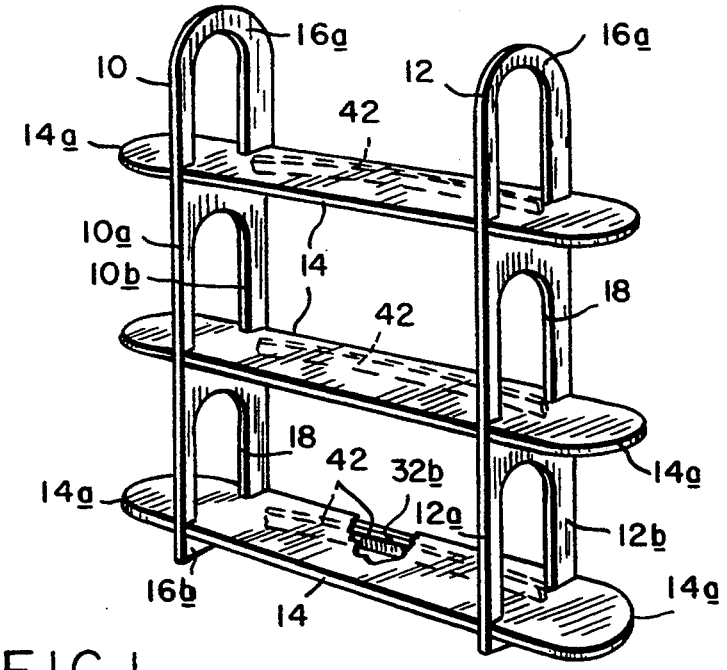
FIG. 1 is an isometric view with parts broken away showing a knock-down bookcase or shelf unit incorporating my invention.

Referring to FIG. 1 of the drawings, my bookcase or shelf unit comprises a pair of upstanding, mirror image side members 10 and 12 which support a plurality of identical shelves 14. The illustrated unit has three such shelves, but a taller unit may have five or six such shelves. The side members anti shelves may be made of wood, fiberboard, plastic or any other comparable rigid material. While the bookcase may be sold in the assembled condition shown in FIG. 1, most usually it is sold in a knocked-down condition as illustrated in FIG. 2.

Each side member 10, 12 has a rounded upper end 16*a* and a squared off lower end 16*b* adapted to rest on a floor or other horizontal surface. The side members 10, 12 are formed with a plurality of relatively large openings 18. For aesthetic reasons, these openings generally follow the contour of the side members as a whole, with each opening having a straight bottom wall 18*a* as best seen in FIG. 2. When the side members 10, 12 are standing upright as shown in FIG. 1, those edges 18*a* are all horizontal, with the corresponding edges in the two side members being at the same level and parallel to one another. Preferably also, for reasons that will become apparent, the openings 18 are displaced toward the front edges of side members 10, 12 so that the side member wall 10*a*, 12*a* in front of each opening 18 is narrower than the side member wall 10*b*, 12*b* behind each opening.

Figure 2:
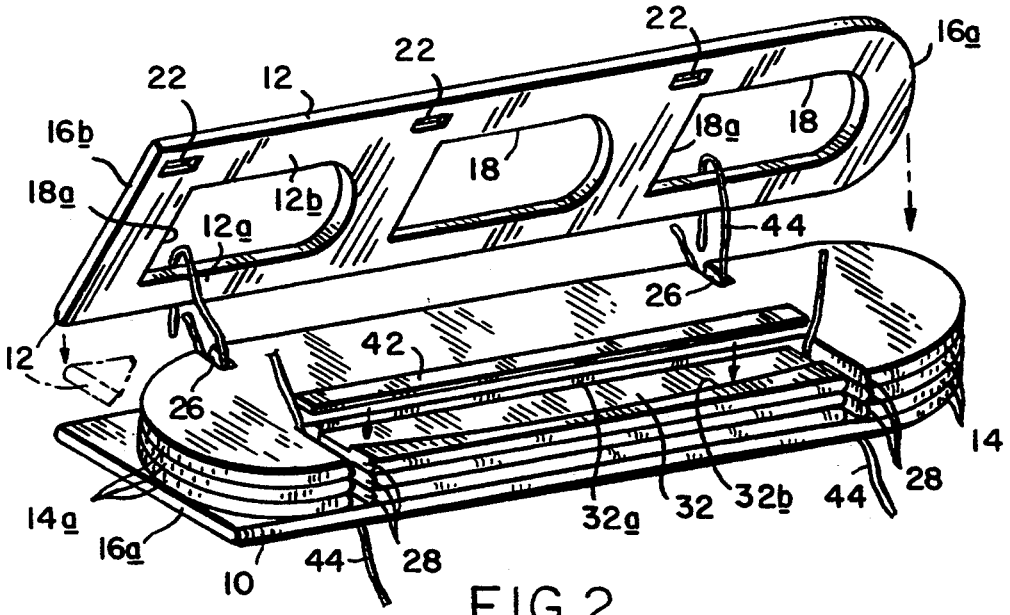
FIG. 2 is a exploded isometric view showing the components of the FIG. 1 bookcase as they are shipped prior to assembly.

As shown in FIG. 2, each side member 10, 12, is provided with a plurality of vertical slots 22, the number of such slots corresponding to the number of openings 18 in the side member. Slots 22 are shown as being located in the wider side member wall 10*b*, 12*b* adjacent to the openings 18 therein. However, they could just as well be positioned in walls 10*a*, 12*a*. Preferably, the upper end of each slot is located slightly above the lower edge 18*a* of the corresponding opening 18 for reasons that will become apparent. The slots 22 in side members 10 and 12 are located on opposite sides of those members so when the two side members stand upright as shown in FIG. 1, the slots 22 in the two members face one another at the rear of the bookcase. Except for the locations of those slots 22, the side members 10 and 12 are identical.

As noted above, shelves 14 are also identical, each shelf having opposite ends 14*a* which are rounded with more or less the same radius as the upper ends 16*a* of the side members 10, 12. As shown in FIG. 2, the shelves have more or less the same length and width as the side members so that all of the unassembled bookcase components can be organized in a relatively flat, compact package, as shown in FIG. 2.

In accordance with the invention, abutment means are provided to prevent shelves 14 from shifting fore and aft and laterally relative to side members 10, 12. Thus in the illustrated bookcase, shelves 14 are provided with slots 26 which extend in from the forward edges of the shelves, those slots being spaced to some extent from the opposite ends of the shelves. Each slot 26 is slightly wider than the thickness of the side members 10, 12 and has a length that corresponds more or less to the width of the side member walls 10*a*, 12*a*. Similar, albeit somewhat longer, slots 28 extend in from the opposite or rear longitudinal edges of shelves 14 directly opposite slots 26. Slots 28 are the same width as slots 26, but their length corresponds more or less to the width of the side member walls 10*b*, 12*b*.

Figure 6:
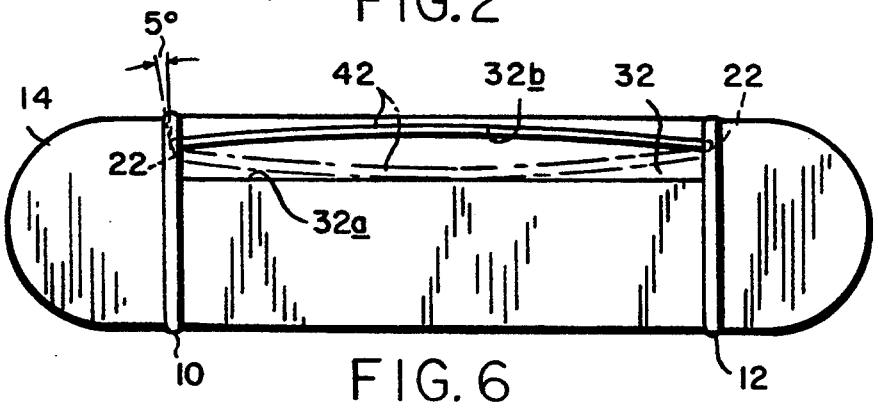
FIG. 6 a bottom plan view on a larger scale of the FIG. 1 bookcase.

As shown in FIGS. 2 and 6, shelves 14 are milled out to form elongated recesses 32 at the undersides of the shelves. Each recess 32 extends the entire distance between the slots 28 in that shelf, or more particularly, between the outboard walls of those slots. The width of each recess 32 is somewhat less than the length of the slots 28. Preferably, the forward wall 32*a* of each recess 32 is straight and extends parallel to the front and rear edges of the corresponding shelf 14. However, the rear wall 32*b* of each recess is outwardly bowed or curved. In other words, the width of each recess 32 is greater midway along the recess than it is at the opposite ends of the recess.

The bookcase also includes a set of elongated rectangular slats 42. Preferably the slats are made of a strong flexible resilient material such as tempered hardboard or the equivalent. Each slat 42 is somewhat narrower than the shelf recesses 32 and is only slightly shorter than those recesses. Usually, the number of slats 42 in the set corresponds to the number of shelves 14 in the bookcase. Thus, in the unit illustrated in the drawing figures, there are three such slats 42.

As shown in FIGS. 1 and 6, when the bookcase is assembled, the slats 42 are positioned on edge under the rear edges of the shelves 14, with their opposite ends being engaged in the slots 22 in the side members 10 and 12. As we shall see, the slats 42 function both as shelf supports and stiffeners for the bookcase as a whole.

The bookcase is normally disassembled when purchased and shipped. Preferably, the components of the bookcase are arranged in the flat package illustrated in FIG. 2, wherein the shelves 14 are sandwiched between the side members 10 and 12. In this knock-down condition, the slats 42 may be seated in the shelf recesses 32. The bookcase components may be held together as a package by four bag ties 44 as shown in FIG. 2. The bag ties are threaded through the "tunnels" at the bottoms of slots 26 and 28 and inside edges of walls 18. The opposite ends of each tie are joined at the perimeter of the package, tied together and pushed into the adjacent slots 26 or 28. This effectively prevents the kit components from seperating or sliding out of place. Then, the package can be enclosed within a fabric or canvas bag (not shown) for presentation and shipment. The bag can be used by the purchaser to store the shelving between deployments or to contain or strore other articles or be returned to the manufacture for a credit.

The illustrated bookcase may be assembled and disassembled by hand without tools or fasteners of any type. Thus, it can be set up and taken apart many times without deterioration, making it especially desirable for people who move their belongings frequently. Moreover, as seen from FIG. 2, it packs for shipping or storage very compactly.

Figure 3:
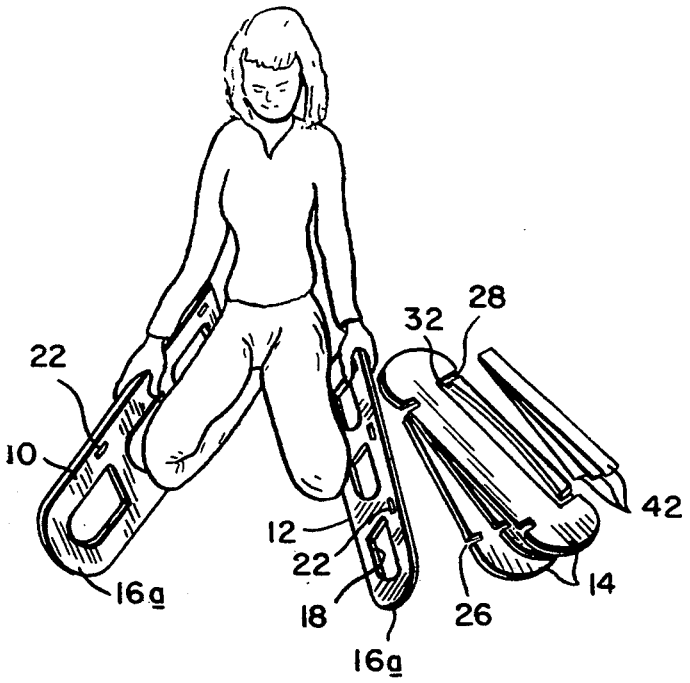
FIGS. 3–5 are diagrammatic views illustrating the assembly of the bookcase.
Figure 4:
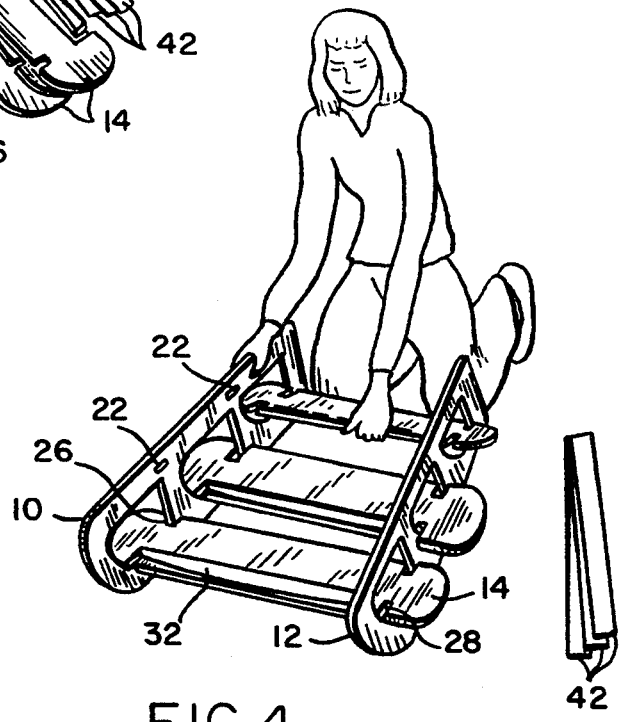
Figure 5:
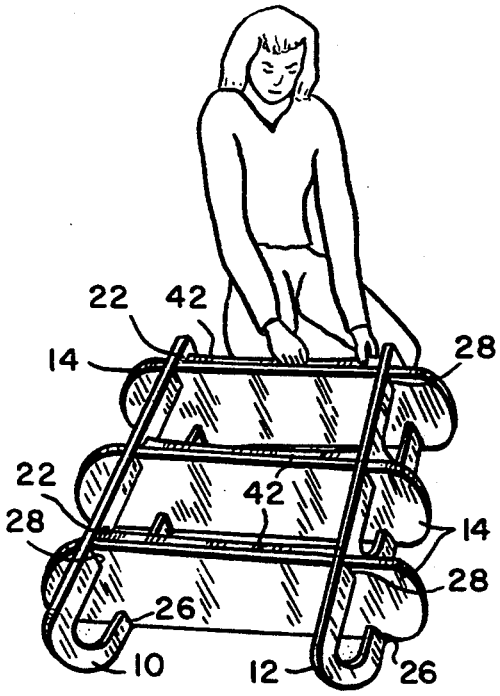

Referring to FIGS. 3 to 5, to assemble the bookcase, one may kneel on the floor and position the two side members, 10, 12 against one's legs such that the rounded upper ends 16*a* of those members face forward and the slots 22 in the side members are on top and face each other as shown in FIG. 3. Then, as shown in FIG. 4, the three shelves 14 may be inserted through corresponding openings 18 in the side members 10, 12, with the recesses 32 facing upwards and the long slots 28 at the ends of those recesses facing forward. The shelf 14 and the slots 26, 28 therein allow the shelves to penetrate through the arched openings 18 in the side members 10, 12 and be rotated into a position in which they rest on the straight bottom edges 18*a* of openings 18, with the slots 26 receiving the walls 10*a*, 12*a* of the side members and the slots 28 receiving the walls 10*b*, 12*b* of those same members. The slot engagement of the shelves with the side members prevents the shelves from moving fore and aft or side to side relative to the side members. Preferably, the slots 26 and 28, as well as the side members, are provided with rounded edges to provide a snug fit between the shelves and the side members and to prevent binding and chipping of the shelf edges during assembly and disassembly of the bookcase.

At this point, after the shelves 14 have been set into the side members 10 and 12, the bookcase still has no lateral stability. Nor do the shelves 14 have any strength to support weight other than their own stiffness as a sheet material. The slats 42 are designed to provide such support and stability.

As shown in FIGS. 5 and 6, the slats 42 are installed under the shelves 14 preferably, but not necessarily, at the rear of the bookcase. To install a slat, one end of the slat is inserted into the slit 22 in one of the side member, e.g., member 10. As shown in FIG. 5, the slat is bowed downwardly in the middle until the opposite end of the slat can be inserted into the corresponding slit 22 in the other side member 12. The slits 22 are positioned with respect to the openings 18 so that when the slat is mounted to the side members as aforesaid, the slat will fit into the recess 32 in the corresponding shelf 14 so that the upper edge of the slat engages the underside of the shelf in the shelf recess 32 thereby providing vertical support for the shelf.

It is important to note that the bowing of the slats which occurs when the slats are installed in the side member slits 22 effectively shortens the overall length of the slats. Once all the shelves and slats are in place, the slats are then snapped reawardly against the curved rear edges 32*b* of the respective recesses 32. This effectively straightens the slats 42 to some extent thereby increasing their overall effective lengths. Resultantly, the slats push outward against the seats of the slits 22 under each shelf 14 where those forces are opposed by the outboard walls of the slots 28. The placement of the slits 22 relative to the edges 32*b* of recesses 32 is such that the slats have to be moved over center in order to seat against the curved rear walls 32*b* of recesses 32. Resultantly, the slats constitute bistable members which are compressed permanently into a slightly bowed condition wherein they lie against the recess walls 32*b* so that they constantly urge the side members 10 and 12 against the walls of the shelf slits 26, 28 thus rigidifying the bookcase as a whole. Of course, abutment means other than recess walls 32*b*, e.g., pegs protruding from the shelves, could be used to hold the slats in that bowed condition.

Preferably, the slits 22 in the side members 10, 12 are cocked or canted about 5° as shown at the left side of FIG. 6 so that the slit direction follows the angle of entry of slots 42 into the slits. This canting minimizes the tendency of each slat to snap out of its overcenter position shown in solid lines in FIG. 6.

When the bookcase is fully assembled as shown in FIGS. 1 and 6, the slats 42 function as beams supporting the shelves 14 from below. Forces are then borne into the bottoms of the slits 22 in the side members 10 and 12 and directly to the floor under the bookcase. Also, the slats 42 pressed firmly into the seats of the slits 22 in the side members 10 and 12 provide lateral rigidity for the bookcase at six points (for a three shelf bookcase), thereby maintaining the rectilinearity of the bookcase and preventing the bookcase from rocking or racking when in use.

The illustrated bookcase can be produced very economically from medium density fiber board. Two and two-fifths bookcases can be fabricated from a single sheet of ½ inch fiber board, with a small amount of waste. The small wastage that is created can be converted easily to a connector useful for joining several bookcase units together laterally. Production of both the side members 10, 12 and the shelves 14 is tailored to a single operation on a numerically controlled router with standard tooling, a procedure typical in the wood products industry. Shelf support and stiffening slats 42, which are preferably of tempered hardboard, give the bookcase considerable strength and rigidity despite its light weight. In a typical shelf unit or bookcase made of medium density fiberboard, each shelf 14 may support a concentrated load of 200 lbs. or more.

With proper dimensioning, the bookcase may accommodate the largest textbook or three-ring binder on the lower shelves 14 and display items, plants, etc. on the "balconies" at the ends of the shelves 14. The upper ends of the side members 10 and 12 projecting above the uppermost shelf 42 provide built-in bookends to accommodate storage for extra large books such as atlases, children's books, etc. The curved upper ends 16*a* of those side members also make convenient handles for moving the bookcase. even when it is loaded, for purposes of cleaning, furniture rearrangement and the like. In appearance, the illustrated bookcase has a clean but articulated look that should appeal to students, apartment dwellers, children, and others.

Further, since the bookcase and its bag container may be made of recycled or waste materials, it should gain strong approval from the growing segment of the consumer market which seeks out recycled and environmentally friendly products for purchase.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention described herein.

I claim:

1. A bookcase and shelf unit comprising a pair of elongated rigid mirror image side members, each side member having opposite ends, a plurality of relatively large openings spaced between said ends, each opening having side and bottom edges, and a plurality of slits, said slits being located adjacent to said openings;

a plurality of elongated rigid shelves, the number of shelves corresponding to the number of openings in each side member, each shelf having opposite ends, and at least one slot extending inward from a longitudinal edge of the shelf and spaced from an end of the shelf, each shelf being arranged to extend through corresponding openings in said side members such that the shelf seats on the bottom edges of said openings with each shelf slot receiving a side edge of a said opening;

abutment means at the underside of each shelf;

a plurality of elongated flexible and resilient slats releasably positioned under said shelves between the side members, each slat having opposite ends engaged in corresponding slits in said side members and a bowed segment between said opposite ends which engages the abutment means of the corresponding shelf to produce a bias which urges the side members apart.

2. The unit defined in claim 1 wherein the slits in each side member are located between the openings and a longitudinal edge of that side member.

3. The unit defined in claim 1 wherein each shelf includes a pair of said slots spaced from opposite ends of said shelf for engaging side edges of corresponding openings in said side members.

4. The unit defined in claim 3 and further including a second pair of slots in each shelf extending in from the other longitudinal edge of the shelf opposite the first pair of slots.

5. The unit defined in claim 3 wherein said abutment means at the underside of each shelf comprise a wall of a longitudinal recess formed in the underside of that shelf.

6. The unit defined in claim 5 wherein the recess in each shelf extends the entire distance between said pair of slots in said shelf.

7. The unit defined in claim 6 wherein the recess in each shelf is located adjacent to a longitudinal edge of said shelf.

8. The unit defined in claim 5 wherein said recess wall is curved.

9. The unit defined in claim 1 wherein each side member defines a plane and each slit is canted at a small angle from the plane of the associated side member.

10. A bookcase and shelf unit comprising a pair of elongated rigid side members, each side member having opposite ends, a plurality of relatively large openings spaced between said ends, each opening having an edge, and a plurality of slits, said slits being located adjacent to said openings;

a plurality of elongated rigid shelves, the number of shelves corresponding to the number of openings in each side member, said shelves being receivable in said side member openings for seating on said opening edges;

means on said shelves for preventing said shelves from shifting laterally relative to said side members;

abutment means at the underside of each shelf, and a plurality of elongated flexible and resilient slats releasably positioned under and supporting said shelves, each slat having opposite ends engaged in corresponding slits in said side members and a bowed segment between said opposite ends which engages the abutment means of the corresponding shelf to produce a bias which urges said side members apart.

11. The unit defined in claim 10 wherein said preventing means comprise one or more slots extending inward from a longitudinal edge of each shelf.

12. The unit defined in claim 10 wherein said shelves have substantially the same outside dimensions and shape as the side members.

13. The unit defined in claim 10 wherein said abutment means at the underside of each shelf includes a wall of a longitudinal recess formed in the underside of that shelf.

14. The unit defined in claim 13 wherein said wall is curved.

15. The unit defined in claim 10 wherein said slits are canted at a small angle from the plane of the associated side member.

* * * * *

UNITED STATES PATENT AND TRADEMARK OFFICE

CERTIFICATE OF CORRECTION

PATENT NO. : 5,363,775

DATED : Nov. 15, 1994

INVENTOR(S) : Barry Simpson

It is certified that error appears in the above-indentified patent and that said Letters Patent is hereby corrected as shown below:

Column 1, line 44, "tile" should be --the--;

Column 1 line 47, "tile" should be --the--;

Column 1 line 56, "tile" should be --the--;

Column 2, line 31, "tile" should be --the--;

Column 5, line 40, "reawardly' should be --rearwardly--;

Signed and Sealed this

Twenty-fifth Day of June, 1996

*Attest:*

BRUCE LEHMAN

*Attesting Officer*

*Commissioner of Patents and Trademarks*